US008035670B2

(12) United States Patent
Shinohara et al.

(10) Patent No.: US 8,035,670 B2
(45) Date of Patent: Oct. 11, 2011

(54) THERMAL TRANSFER SHEET, THERMAL TRANSFER SHEET SET, AND IMAGE FORMING METHOD

(75) Inventors: Satoru Shinohara, Miyagi (JP); Yasushi Hirumi, Kanagawa (JP); Masanobu Hida, Miyagi (JP)

(73) Assignee: Sony Corporation, Tokyo (JP)

( * ) Notice: Subject to any disclaimer, the term of this patent is extended or adjusted under 35 U.S.C. 154(b) by 451 days.

(21) Appl. No.: 12/360,617

(22) Filed: Jan. 27, 2009

(65) Prior Publication Data

US 2009/0202726 A1 Aug. 13, 2009

(30) Foreign Application Priority Data

Feb. 7, 2008 (JP) ..... 2008-028033

(51) Int. Cl.
*B41M 1/14* (2006.01)

(52) U.S. Cl. ..... 347/175; 347/172; 347/171

(58) Field of Classification Search ..... 347/171, 347/172, 173, 174, 175, 176
See application file for complete search history.

(56) References Cited

U.S. PATENT DOCUMENTS

| | | | | |
|---|---|---|---|---|
| 4,672,393 | A * | 6/1987 | Uchikata et al. | 347/172 |
| 2004/0041898 | A1* | 3/2004 | Nakamura | 347/172 |

FOREIGN PATENT DOCUMENTS

| | | |
|---|---|---|
| JP | 01-136787 | 5/1989 |
| JP | 01-165486 | 6/1989 |
| JP | 02-000587 | 1/1990 |
| JP | 02-265790 | 10/1990 |
| JP | 01-226393 | 8/1992 |
| JP | 07-214804 | 8/1995 |
| JP | 07-304272 | 11/1995 |
| JP | 10-086535 | 4/1998 |

* cited by examiner

*Primary Examiner* — Julian Huffman
*Assistant Examiner* — Sharon A Polk
(74) *Attorney, Agent, or Firm* — SNR Denton US LLP

(57) ABSTRACT

A thermal transfer sheet includes coloring material layers $D_1$, $D_2$, and $D_3$. Transferred images respectively formed by the coloring material layers $D_1$, $D_2$, and $D_3$ have a value C defined by mathematical formula 1 of less than 12, and colorimetric values P (a*, b*) defined by mathematical formulae 2 and 3 different from one another:

$$C=([a^*]^2+[b^*]^2)^{0.5} \quad \text{(mathematical formula 1)}$$

where C represents chroma and a* and b* each represent a colorimetric value equivalent to L*=38, $$[a^*]=(ay-ax)/(Ly-Lx)*(38-Lx)+ax \quad \text{(mathematical formula 2), and}$$

$$[b^*]=(by-bx)/(Ly-Lx)*(38-Lx)+bx \quad \text{(mathematical formula 3)}$$

where Lx, ax, bx, Ly, ay, and by represent colorimetric values at adjacent step Sx and step Sy near L*=38 when a stairstep image is formed by transfer.

3 Claims, 8 Drawing Sheets

THERMAL TRANSFER SHEET, THERMAL TRANSFER SHEET SET, AND IMAGE FORMING METHOD

CROSS REFERENCES TO RELATED APPLICATIONS

The present invention contains subject matter related to Japanese Patent Application JP 2008-028033 filed in the Japanese Patent Office on Feb. 7, 2008, the entire contents of which are incorporated herein by reference.

BACKGROUND OF THE INVENTION

1. Field of the Invention

The present invention relates to a thermal transfer sheet having two or more types of coloring material layers, a thermal transfer sheet set including a plurality of thermal transfer sheets each having different types of coloring material, and an image forming method that uses the thermal transfer sheet and the thermal transfer sheet set. In particular, the present invention relates to a black-based thermal transfer sheet having a color toning function, a black-based thermal transfer sheet set, and an image forming method using the black-based thermal transfer sheet or the black-based thermal transfer sheet set.

2. Description of the Related Art

Dye sublimation transfer technology has been available as one technique for creating color hard copies. The dye sublimation transfer technology uses a thermal transfer sheet including a substrate film having a heat-resistant lubricating layer on one surface and a coloring material layer on the other surface, in combination with a thermal transfer-receiving sheet including a substrate having an image-receiving layer on at least one surface. According to the dye sublimation thermal transfer technology, a surface of the thermal transfer sheet on which the coloring material layer is formed is arranged to face a surface of the thermal transfer-receiving sheet on which the image-receiving layer is formed, and thermal energy corresponding to an image to be transferred is applied by a thermal head through a heat resistant lubricating layer surface of the thermal transfer sheet so as to allow dye molecules in the coloring material layer of the thermal transfer sheet to migrate to the image-receiving layer surface of the thermal transfer-receiving sheet and to thereby form a transferred image on the thermal transfer-receiving sheet. Since the dye sublimation transfer technology can provide continuous density gradation within one pixel, it is suitable for outputting photographic images.

There has been a demand to create monochromic prints by the dye sublimation thermal transfer technology. Monochromic prints can be obtained by using coloring material layers having the following features:

Method 1: Use of Color Thermal Transfer Sheet

According to method 1, a thermal transfer sheet having yellow, magenta, cyan, and, if necessary, black coloring material layers is used and black/gray tone is obtained by subtractive mixing of these colors. According to method 1, gray-tone prints of a desired hue can be obtained by differentiating the thermal energy distribution ratios for yellow, magenta, and cyan material layers.

However, according to method 1, unintended hue shift occurs in low-density portions of a gray tone print. The term "hue shift" refers to subtle differences in tone between portions with high and low densities that occur during image formation. Whereas a monochromic image should have a constant tone from low-gradation to high-gradation, phase shift causes lack of tone consistency in the monochromic image, which is not preferable. The hue shift is attributable to instability of reproducibility in repeating transfer of dyes by heat application using a thermal head. In other words, according to the method 1, since chroma of the color material layers of three primary colors is originally high, in low-density gray regions, subtle changes in ambient temperature and the temperature of the entire thermal head cause changes in gray tone between different levels of gradation.

Following two methods are also available as methods for obtaining monochromic prints.

Method 2: Use of Monochromic Thermal Transfer Sheet

In method 2, a thermal transfer sheet including an achromatic color material layer is used. Examples of the monochromatic thermal transfer sheet include those having the following coloring material layers, all of which create an achromatic color by imparting absorption over substantially the entire visible light range:

(1) a color layer composed of one type of black-based dye (e.g., refer to Japanese Unexamined Patent Application Publication No. 1-165486 and 2-265790)

(2) a color layer combining a plurality of types of low-chroma dyes having different maximum absorption wavelengths (e.g., see Japanese Unexamined Patent Application Publication No. 4-226393 and 10-86535)

(3) a color layer made achromatic by combining dyes corresponding to three primary colors for subtractive mixing (e.g., see Japanese Unexamined Patent Application Publication No. 1-136787 and 7-304272).

In the case where the coloring material layer (2) is used, a sufficient maximum print density (reflection density of 2 or more) may not be obtained by conducting thermal transfer once. In order to overcome this drawback, coloring material layers of the same color tone are superimposed a plurality of times to increase the maximum print density (e.g., see to Japanese Unexamined Patent Application Publication No. 2-587).

Japanese Unexamined Patent Application Publication No. 7-214804 describes one example of a method for forming an image of a desired color tone in making a monochromic print. The method described in '804 document proposes use of a thermal transfer sheet having a plurality of coloring material layers with symmetric hues of opposite types to obtain a desired color tone.

In method 2, the tone of the gray print is preset and the tone can rarely be changed according to the preference of the user at the site of printing. In order to overcome this drawback, '804 document proposes use of two different types of ink sheets having different hues to obtain a desired tone. However, the selection of the hue is limited to contrastive hues, and the document does not address the problem of hue shift between the low-print-density and high-print-density portions or possible solutions for hue shift.

Another problem with the monochromic thermal transfer sheets (1) to (3) above is that it is difficult to obtain a coloring material layer having a high sensitivity. This is due to the following reasons, which are described according to the composition of the monochromic thermal transfer sheet.

The thermal transfer sheet including a color layer composed of one type of black-base dye described in (1) tends to have a large molecular weight, low dye transfer efficiency, and difficulty in achieving high sensitivity.

As for the thermal transfer sheet having a layer combining a plurality of types of low-chroma dyes having different maximum absorption wavelengths set forth in (2) and the thermal transfer sheet having a layer made achromatic by combining dyes corresponding three primary colors for subtractive mixing set forth in (3), the half value width at the maximum absorption wavelength of each dye used is small in the thermal transfer sheet of (2) and smaller in the thermal transfer sheet of (3), thereby requiring many types of dyes.

Furthermore, the blend ratio of the dye constituting the coloring material layer to the binder constituting the coloring material layer is limited in view of stable dye retention. If the thermal transfer sheet has a dye/binder blend ratio exceeding the upper limit, the dyes may precipitate in the coloring material layer. Because of such restriction, the amount of dye usable for each component becomes more and more limited as the number of types of dyes used increases, and it becomes difficult to transfer a sufficient amount of coloring material (about 2 in terms of maximum print density) by conducting the transfer of the coloring material layer only once. Although this drawback can be overcome by the method described in Japanese Unexamined Patent Application Publication No. 2-587, the problem of lack of choice of tone remains unresolved.

As described above, although the thermal transfer sheets described above have been used to obtain a monochromic print by the dye sublimation transfer technology, it has been difficult to achieve a print density of a practical level, to render the hue shift in the low-density regions less noticeable, and to satisfactorily achieve a desired gray tone.

SUMMARY OF THE INVENTION

The present invention provides a thermal transfer sheet by which a low-chroma print that achieves a print density of a practical level, renders the hue shift in the low-density regions less noticeable, and satisfactorily creates a gray tone (e.g., reddish or bluish) desired by users can be formed. A thermal transfer sheet set, and an image-forming method using the thermal transfer sheet or the thermal transfer set are also provided.

One embodiment provides a thermal transfer sheet a that includes a substrate and a plurality of coloring material layer units disposed on one surface of the substrate in a plane sequential manner, each of the coloring material layer units including at least two types of coloring material layers arranged parallel to each other, the coloring material layers containing coloring materials. The coloring materials are thermally transferred onto an image-receiving layer of a thermal transfer-receiving sheet superimposed with the thermal transfer sheet to form transferred images. The transferred images formed by the coloring material layers in each coloring material unit have a value C defined by mathematical formula 1 below of less than 12. The colorimetric values P (a*, b*) of the transferred images defined by mathematical formulae 2 and 3 below are different from one another within each coloring material unit:

$$C=([a^*]^2+[b^*]^2)^{0.5} \quad \text{(mathematical formula 1)}$$

where C represents chroma and a* and b* each represent a colorimetric value (CIE 1976 L*a*b* color space with D65 illuminant, 2° field of view) equivalent to L*=38;

$$[a^*]=(ay-ax)/(Ly-Lx)*(38-Lx)+ax \quad \text{(mathematical formula 2)}$$

$$[b^*]=(by-bx)/(Ly-Lx)*(38-Lx)+bx \quad \text{(mathematical formula 3)}$$

where Lx, ax, bx, Ly, ay, and by represent colorimetric values at adjacent step Sx and step Sy near L*=38 when stairstep images are formed by transfer on the image-receiving layer of the thermal transfer-receiving sheet by using the coloring material layers; and Colorimetric values (L*, a*, b*) at step Sx=(Lx, ax, bx)

Colorimetric values (L*, a*, b*) at step Sy=(Ly, ay, by)

where Lx<38<Ly or Lx>38>Ly.

Another embodiment provides a thermal transfer sheet set that includes a plurality of thermal transfer sheets each including a substrate and a different type of coloring material layers formed on one surface of the substrate, the coloring material layers including coloring materials, in which the coloring materials are thermally transferred onto an image-receiving layer of a thermal transfer-receiving sheet superimposed with the thermal transfer sheets to form transferred images, the transferred images formed by the coloring material layers of the thermal transfer sheets have a value C defined by mathematical formula 1 described above of less than 12, and colorimetric values P (a*, b*) of the transferred images defined by mathematical formulae 2 and 3 described above are different from each other between the thermal transfer sheets within the thermal transfer sheet set.

Still another embodiment provides a method for forming an image, including superimposing a thermal transfer sheet on a thermal transfer-receiving sheet; and thermally transferring a coloring material contained in a coloring material layer of the thermal transfer sheet onto an image-receiving layer of the thermal transfer-receiving sheet so as to form a transferred image, in which at least two types of coloring material layers are used and thermal transfer of the coloring material from the coloring material layer onto the thermal transfer-receiving sheet is sequentially conducted to form transferred images, the transferred images formed by the coloring material layers have a value C defined by mathematical formula 1 described above of less than 12, and colorimetric values P (a*, b*) of the transferred images defined by mathematical formulae 2 and 3 described above are different from one another between the coloring material layers of the thermal transfer sheet.

The chroma values C defined by mathematical formula 1 of the transferred images formed by using the coloring material layers are less than 12, and the colorimetric values P (a*, b*) defined by mathematical formulae 2 and 3 of the transferred images are different from each other between the coloring material layers. By using such coloring material layers, a print density of a practical level can be achieved, hue shift in the low-density-regions can be rendered less noticeable, and a desired gray tone can be created. Thus, a low-chroma print that satisfies all of these features can be obtained.

DESCRIPTION OF THE PREFERRED EMBODIMENTS

Preferred embodiments of a thermal transfer sheet, a thermal transfer sheet set, and an image forming method will now be described in detail with reference to the drawings.

In the embodiments, to increase the dye ratio is an important factor for achieving a black density in forming a monochromic image. In creating black by superimposing two or three printed images, a black ink is used instead of three primary color inks to suppress color jumps near achromatic colors (subtle differences in tone between adjacent steps, lack of smoothness in tone), which are problem that arises during printing with three primary colors (especially in low-density portions). Color jumps are attributable to reproducibility of repeatedly transferring dyes by heating with a thermal head and are easily affected by ambient temperature or the temperature of the entire head. In particular, in reproducing a low-density gray tone, the gray tone undergoes subtle changes for every tone level. Although such changes are not easily digitalized colorimetrically, human eyes are highly sensitive and can easily recognize such changes. In the embodiments, a thermal transfer sheet having a low chroma is used to suppress color jumps (hue shift). In other words, the dye transfer errors are made less noticeable by decreasing the chroma.

Figure 1:
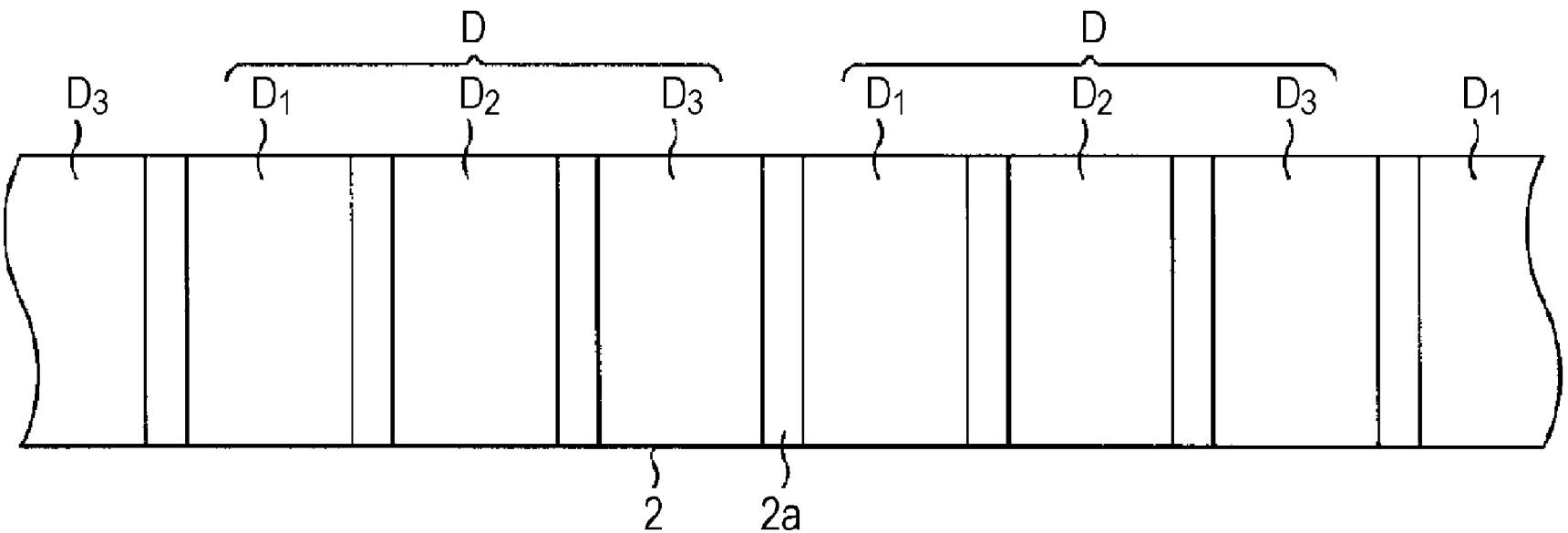
FIG. 1 is a plan view of a thermal transfer sheet according to one embodiment.

In the embodiment, a thermal transfer sheet 1 shown in FIG. 1 is used to form a monochromic print by the dye sublimation thermal transfer technology. The thermal transfer sheet 1 includes a substrate 2 having a surface 2*a* on which coloring material layer units D each including a plurality of types of low-chroma coloring material layers Dn (wherein n is 2 or greater), i.e., three coloring material layers $D_1$, $D_2$, and $D_3$ in the example shown in the drawing, are formed in a plane sequential manner. The thermal transfer sheet 1 has at least two types of coloring material layers. The thermal transfer sheet 1 is loaded onto a thermal transfer printing apparatus 10 shown in FIG. 2, and dyes on the thermal transfer sheet 1 are thermally transferred onto a thermal transfer-receiving sheet 11, such as a printing paper, fed to the thermal transfer printing apparatus 10, to form a monochromic image (transferred image).

Figure 2:
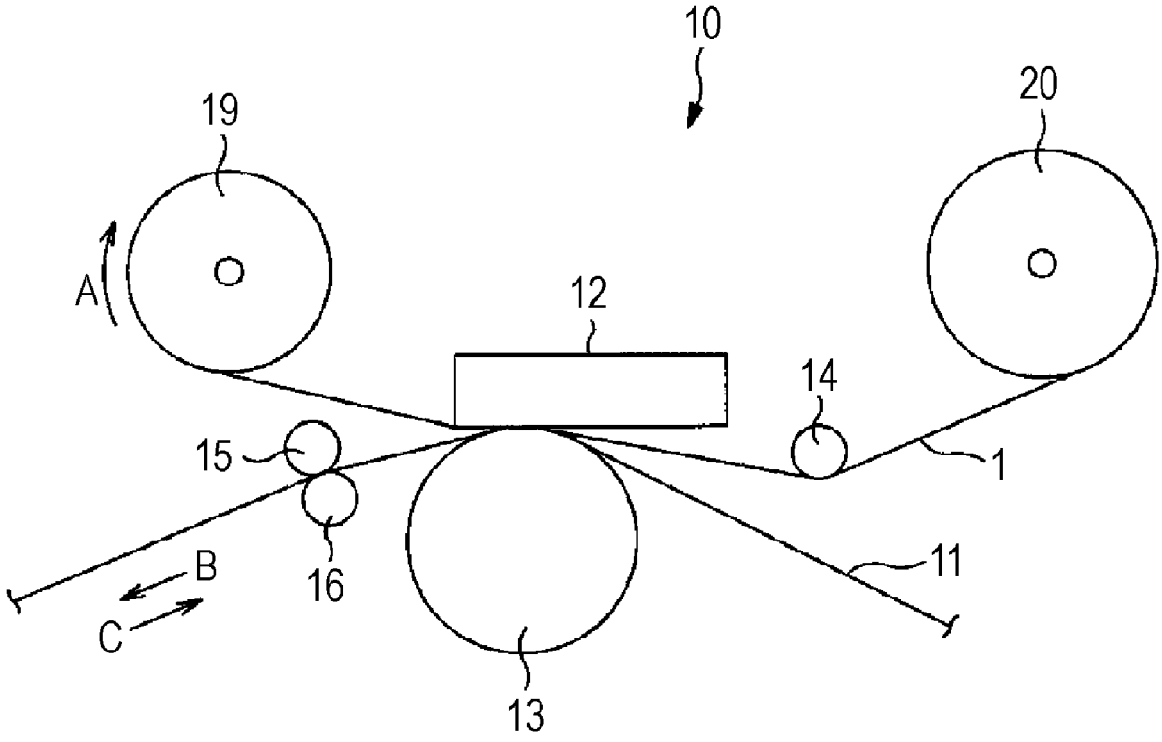
FIG. 2 is a schematic view of a thermal transfer printing apparatus.

The thermal transfer printing apparatus 10 employs the dye sublimation thermal transfer technology. As shown in FIG. 2, the thermal transfer printing apparatus 10 includes a thermal head 12 for heating the coloring material layers $D_1$, $D_2$, and $D_3$ of the thermal transfer sheet 1 from the back of the substrate 2; a platen 13 arranged to oppose the thermal head 12 so that the thermal transfer sheet 1 is interposed between the thermal head 12 and the platen 13; a guide roller 14 for guiding the thermal transfer sheet 1 mounted; and a pinch roller 15 and a capstan roller 16 for allowing the thermal transfer sheet 1 and the thermal transfer-receiving sheet 11 to travel between the thermal head 12 and the platen 13.

In the thermal transfer printing apparatus 10 having such a configuration, as shown in FIG. 2, a take-up spool 19 for the thermal transfer sheet 1 is rotated in the winding direction indicated by arrow A in the drawing so as to allow the thermal transfer sheet 1 to travel from a supply spool 20 to the take-up spool 19 between the thermal head 12 and the platen 13. The thermal transfer-receiving sheet 11 is interposed between the pinch roller 15 and the capstan roller 16 and allowed to travel in the paper discharging direction by rotating the capstan roller 16 in the discharging direction indicated by arrow B in the drawing so that the leading end of an image forming region of the thermal transfer-receiving sheet 11 opposes the thermal head 12.

In order to print an image on the thermal transfer-receiving sheet 11, thermal energy is selectively applied from the thermal head 12 to the coloring material layer $D_1$, which is the first layer in the coloring material layer unit D of the thermal transfer sheet 1, based on image data. As a result, the dye in the coloring material layer $D_1$ is thermally transferred onto the thermal transfer-receiving sheet 11 that travels while being superimposed with the thermal transfer sheet 1. Upon completion of thermal transfer of the dye of the coloring material layer $D_1$, the thermal transfer-receiving sheet 11 is conveyed toward the thermal head 12 (arrow C direction in FIG. 2) to thermally transfer the dye in the coloring material layer $D_2$, which is the second layer of the coloring material layer unit D, onto the image forming region of the thermal transfer-receiving sheet 11. The leading end of the image forming region is again arranged to oppose the thermal head 12, and the coloring material layer $D_2$ of the thermal transfer sheet 1 is arranged to oppose the thermal head 12. As with the case of thermally transferring the dye in the coloring material layer $D_1$, thermal energy is selectively applied from the thermal head 12 to the coloring material layer $D_2$ based on the image data so as to thermally transfer the dye in the coloring material layer $D_2$ onto the image forming region of the thermal transfer-receiving sheet 11. The dye in the coloring material layer $D_3$ is also thermally transferred onto the thermal transfer-receiving sheet 11 in the same manner as with the coloring material layer $D_2$. A monochromic image is printed as a result.

The thermal transfer-receiving sheet 11 on which a monochromic image is printed may be any sheet having a recording surface that can accept the dyes from the thermal transfer sheet 1 and receive the image. Alternatively, the thermal transfer-receiving sheet 11 may be made of a material that does not have image-receiving capacity, such as paper, metal, glass, and synthetic resin. In the case where the thermal transfer-receiving sheet 11 is composed of such a material, a transfer-type image-receiving layer may be transferred from the thermal transfer sheet 1 onto the surface of the thermal transfer-receiving sheet 11 or an image-receiving layer may be formed in at least part of the surface of the thermal transfer-receiving sheet 11, i.e., in at least the image-forming region, in advance. Even when the thermal transfer-receiving sheet 11 has image-receiving capacity, an image-receiving layer may be formed on the recording surface.

The specific procedure for thermally transferring the dyes onto the thermal transfer-receiving sheet 11 by using the thermal transfer printing apparatus 10 to form a monochromic image will now be described in detail.

As shown in FIG. 1, the thermal transfer sheet 1 includes the substrate 2 having the surface 2*a* on which the coloring material layer units D each including three coloring material layers $D_1$, $D_2$, and $D_3$ having low chroma are formed in a plane sequential manner. A heat-resistant lubricating layer may be formed on the back of the substrate 2 if necessary.

The substrate 2 may be any existing substrate that has some degree of heat resistance and strength. Examples of the substrate 2 include paper sheets, converted paper sheets, polyester films, polystyrene films, polypropylene films, polysulfone films, polycarbonate films, polyvinyl alcohol films, polyimide films, polyamideimide films, polyether ether ketone films, cellophane sheets, and the like which are long and have a thickness of about 0.5 μm to 50 μm, preferably about 3 μm to 15 μm.

The coloring material layers $D_1$, $D_2$, and $D_3$ are each mainly composed of a dye and a binder resin for supporting the dye.

Examples of the dye include C. I. Disperse Orange 13, C. I. Disperse Blue 148, C. I. Disperse Violet 26, and C. I. Disperse Red 343. Dyes represented by chemical formulae 1 and 2 below may also be used:

(Chem. formula 1)

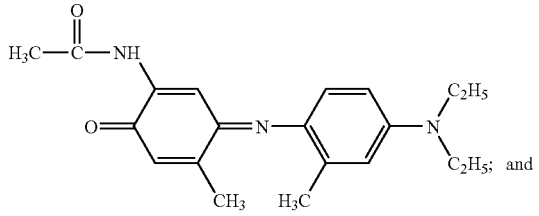

(Chem. formula 2)

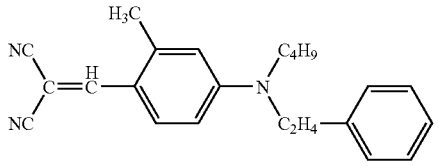

These dyes, alone or in combination, may be used to form the coloring material layers $D_1$, $D_2$, and $D_3$.

Any existing binder resin can be used as the binder resin for supporting the dye in the coloring material layers $D_1$, $D_2$, and $D_3$. Examples of the binder resin include cellulose resins, vinyl resins, and acrylic resins. These binder resins may be used as a mixture or a copolymer.

The value C defined by mathematical formula 1 below of each of the transferred images respectively formed by using the coloring material layers $D_1$, $D_2$, and $D_3$ within the coloring material layer unit D is less than 12; moreover, the colorimetric values P (a*, b*) defined by mathematical formulae (2) and (3) of the transferred images formed by the coloring material layers $D_1$, $D_2$, and $D_3$ are different from one another:

$$C=([a^*]^2+[b^*]^2)^{0.5} \quad \text{(mathematical formula 1)}$$

where C represents chroma, a* and b* each represent a colorimetric value equivalent to L*=38 of the transferred images formed by the coloring material layers $D_1$, $D_2$, and $D_3$ (CIE 1976 L*a*b* color space with D65 illuminant, 20 field of view) and defined by mathematical formulae 2 and 3 below)

$$[a^*]=(ay-ax)/(Ly-Lx)*(38-Lx)+ax \quad \text{(mathematical formula 2)}$$

$$[b^*]=(by-bx)/(Ly-Lx)*(38-Lx)+bx \quad \text{(mathematical formula 3)}$$

where Lx, ax, bx, Ly, ay, and by represent colorimetric values at adjacent step Sx and step Sy near L*=38 when stairstep images are formed by transfer on the image receiving layer surface of the thermal transfer-receiving sheet 11 by using the coloring material layers $D_1$, $D_2$, and $D_3$. Furthermore:

colorimetric values (L*, a*, b*) at step Sx=(Lx, ax, bx)

colorimetric values (L*, a*, b*) at step Sy=(Ly, ay, by)

where Lx<38<Ly or Lx>38>Ly.

A stairstep transferred image is an image created by preparing five types of luminance data profiles each in which 256 gradation steps of RGB (0 to 255) are divided into 16 steps, selecting one luminance data profile therefrom to set the luminance profile of each of the RGB channels, and printing a bitmap image data of a 16-step stairstep pattern on the basis of the luminance data profile.

A method for preparing bitmap image data of a 16-step stairstep pattern is described below by way of examples. First, a thermal transfer sheet 1 was prepared by respectively replacing yellow, magenta, and cyan color patches of a thermal transfer sheet of Print Pack (UPC-R154H produced by Sony Corporation) with coloring material layers $D_1$, $D_2$, and $D_3$ (hereinafter referred to as coloring material layers I, II, and III) shown in Table 1. The coloring material layers I, II, and III were arranged in a plane sequential manner.

In particular, coating solution compositions for forming the coloring material layers I, II, and III containing components indicated in Table 1 below were applied on a surface of a polyethylene terephthalate film (the other surface of which is provided with a heat-resistant lubricating layer) 4.5 μm in thickness by using a wire-bar #8 and dried at 110° C. for 1 minute to form a thermal transfer sheet 1 with coloring material layers I, II, and III.

TABLE 1

(Unit: parts by weight)

| | Coloring material layers | | |
|---|---|---|---|
| | I | II | III |
| C.I. Disperse Orange 13 | 1.784 | 1.428 | 1.655 |
| C.I. Disperse Blue 148 | 1.784 | 1.905 | 1.399 |
| C.I. Disperse Violet 26 | — | 0.203 | 0.149 |

TABLE 1-continued (Unit: parts by weight)

| | Coloring material layers | | |
|---|---|---|---|
| | I | II | III |
| C.I. Disperse Red 343 | 0.032 | 0.063 | 0.396 |
| Denka Butyral 6000AS (acetoacetal resin produced by Denki Kagaku Kogyo Kabushiki Kaisha) | 2.400 | 2.400 | 2.400 |
| Methyl ethyl ketone | 47.000 | 47.000 | 47.000 |
| Toluene | 47.000 | 47.000 | 47.000 |
| Total | 100.000 | 100.000 | 100.000 |

The resulting thermal transfer sheet 1 and a thermal transfer-receiving sheet of Print Pack UPC-R154H produced by Sony Corporation were loaded in a color dye sublimation thermal transfer printing apparatus (DR150 produced by Sony Corporation). A bitmap image data (16-step stairstep pattern) was printed on the basis of one luminance data profile selected from the five data profiles (N, H, L, HS, and HW) having different RGB luminance balances indicated in Table 2 to obtain a 16-step stairstep transferred image. In printing, the same linear γ was used for each of the coloring material layers I, II, and III.

are Y=255−B, M=255−G, and C=255−R. Thus, the luminance data profiles shown in Table 2 are converted on the basis of these relationships into energy profiles Em (m=an integer of 1 to 3) of the energy applied to the coloring material layers I, II, and III shown in Table 3. In this example, the profile data indicated in Tables 2 and 3 is used to change the ratio of the energy applied to the coloring material layers I, II, and III, but this by no means limits the scope of the present invention.

For each of the coloring material layers I, II, and III, the colorimetric values at adjacent steps Sx and Sy near L*=38 were measured from among the 16-step stairstep pattern images. In other words, the colorimetric values at step Sx, (L*, a*, b*)=(Lx, ax, bx) and at step Sy, (L*, a*, b*)=(Ly, ay, by) were determined. Here, Lx<38<Ly or Lx>38>Ly.

The colorimetric values (L*, a*, b*) of steps Sx and Sy were determined by analyzing the resulting 16-step stairstep pattern image with a densitometer, SpectroEye produced by Macbeth Gretag. Measurement was conducted with a D65 illuminant, 2° field of view, and ANSI A filter, and the maximum print density (ODmax) and color coordinates in the CIE 1976 (L*, a*, b*) color space were determined. The colorimetric values (Lx, ax, bx) at step Sx and (Ly, ay, by) at step Sy, and ODmax are shown in Table 4. The colorimetric values a*, b* equivalent to L*=38 were determined from mathematical formulae 2 and 3 based on the determined colorimetric values (Lx, ax, bx) and (Ly, ay, by) at steps Sx and Sy. The reason for using the L*=38 equivalent as the standard is because ODmax is 1 or more and thus sufficiently high print density can be obtained. The chroma C equivalent to L*=38 was determined for each of the images formed by the coloring material layers I, II, and III by using mathematical formula 1 on the basis of a*, b* determined. The chroma C of images formed by the coloring material layers I, II, and III is shown in Table 4.

TABLE 2

| | Step | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| N (linear) | 255 | 238 | 221 | 204 | 187 | 170 | 153 | 136 | 119 | 102 | 85 | 68 | 51 | 34 | 17 | 0 |
| H (highlight) | 255 | 237 | 217 | 197 | 177 | 157 | 137 | 117 | 97 | 77 | 57 | 37 | 17 | 0 | 0 | 0 |
| L (limit) | 255 | 243 | 230 | 217 | 204 | 191 | 178 | 165 | 152 | 139 | 126 | 113 | 101 | 80 | 45 | 0 |
| HS (highlight strong) | 255 | 236 | 213 | 190 | 167 | 144 | 121 | 98 | 75 | 52 | 35 | 18 | 10 | 0 | 0 | 0 |
| HW (highlight weak) | 255 | 237 | 217 | 197 | 177 | 157 | 137 | 117 | 97 | 77 | 57 | 37 | 17 | 10 | 0 | 0 |

TABLE 3

| | Step | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| N (linear) | 0 | 17 | 34 | 51 | 68 | 85 | 102 | 119 | 136 | 153 | 170 | 187 | 204 | 221 | 238 | 255 |
| H (highlight) | 0 | 18 | 38 | 58 | 78 | 98 | 118 | 138 | 158 | 178 | 198 | 218 | 238 | 255 | 255 | 255 |
| L (limit) | 0 | 12 | 25 | 38 | 51 | 64 | 77 | 90 | 103 | 116 | 129 | 142 | 154 | 175 | 210 | 255 |
| HS (highlight strong) | 0 | 19 | 42 | 65 | 88 | 111 | 134 | 157 | 180 | 203 | 220 | 237 | 245 | 255 | 255 | 255 |
| HW (highlight weak) | 0 | 18 | 38 | 58 | 78 | 98 | 118 | 138 | 158 | 178 | 198 | 218 | 238 | 245 | 255 | 255 |

In preparing the image data for the stairstep transferred image, one luminance data profile was independently selected from the five luminance data profiles (N, H, L, HS, and HW) shown in Table 2 to set the luminance profile of each of the RGB channels. In this example, each of the RGB channels was set to a luminance profile N shown in Table 2.

The relationships between the RGB luminance data shown in Table 2 and the amount of energy applied from a color dye sublimation thermal transfer printing apparatus to the coloring material layers I, II, and III of the thermal transfer sheet 1

TABLE 4

| Image | Coloring material | Corresponding coloring material | Printing E | | | | | P | | | | | | | | OD |
|---|---|---|---|---|---|---|---|---|---|---|---|---|---|---|---|---|
| No. | layer used | layer | I | II | III | C | L* | a* | b* | Lx | Ly | ax | ay | bx | by | (max) |
| a | D1 | I | N | — | — | 4.63 | equivalent to 38 | −3.92 | 2.46 | 38.03 | 32.25 | −3.92 | −3.65 | 2.46 | 2.21 | 1.32 |
| b | D2 | II | — | N | — | 8.34 | equivalent to 38 | −0.43 | −8.33 | 40.53 | 34.96 | −0.65 | −0.16 | −8.05 | −8.66 | 1.39 |
| c | D3 | III | — | — | N | 10.56 | equivalent to 38 | 10.48 | 1.22 | 42.17 | 36.81 | 9.52 | 10.76 | 1.40 | 1.17 | 1.21 |

As shown in Table 4, all of the chroma values C, determined by mathematical formula 1 and equivalent to L*=38, of images (transferred images) a to c formed by the coloring material layers I, II, and III are less than 12, and the colorimetric values P (a*, b*) of the images a to c formed by the coloring material layers I, II, and III are different from one another. The images a to c formed by the coloring material layers I, II, and III are plotted in the L*a*b* chromaticity diagram as indicated by a to c in FIG. 3.

The values C of the images formed by the coloring material layers I, II, and III defined by mathematical formula 1 can be less than 12 and the colorimetric values P (a*, b*) of the images formed by the coloring material layers I, II, and III can be made different from one another by adjusting the type and amount of coloring materials to be contained in the coloring material layers I, II, and III.

Next, two of the coloring material layers I, II, and III were used to form an image. Two printed images formed by the two of the coloring material layers I, II, and III shown in Table 5 were superimposed to form one image. The values C and the colorimetric values a*,b* of an image d formed with the coloring material layers I and II, an image e formed with the coloring material layers II and III, and an image f formed with the coloring material layers I and III are shown in Table 5. The images d to f were plotted in the L*a*b* chromaticity diagram of FIG. 3 as indicated by d to f in the diagram. The energy applied to the coloring material layers I, II, and III had an energy profile N shown in Table 3.

TABLE 5

| Image | Coloring material | Corresponding coloring material | Printing E | | | | | P | | | | | | | | OD |
|---|---|---|---|---|---|---|---|---|---|---|---|---|---|---|---|---|
| No. | layer used | layer | I | II | III | C | L* | a* | b* | Lx | Ly | ax | ay | bx | by | (max) |
| d | D1-D2 | I-II | N | N | — | 4.10 | equivalent to 38 | −1.87 | −3.65 | 42.36 | 34.00 | −2.06 | −1.70 | −3.74 | −3.56 | 1.98 |
| e | D2-D3 | II-III | — | N | N | 5.89 | equivalent to 38 | 5.61 | −1.81 | 41.18 | 33.15 | 5.14 | 6.32 | −1.91 | −1.66 | 1.86 |
| f | D1-D3 | I-III | N | — | N | 5.34 | equivalent to 38 | 4.70 | 2.54 | 43.28 | 35.05 | 4.06 | 5.05 | 2.19 | 2.74 | 1.84 |

Next, printing was conducted by using all of the coloring material layers I, II, and III so that images formed by the coloring material layers I, II, and III were superimposed. The values C and the colorimetric values a*, b* of resulting images g to m are shown in Table 6. The images g to m were plotted in the L*a*b* chromaticity diagram of FIG. 3 as indicated by g to m in the diagram. In forming the image g, energy was evenly applied to all of the coloring material layers I, II, and III (the applied energy profile N shown in Table 3). In forming the printed images h to j, one of the coloring material layers I, II, and III was highlighted (the applied energy profile H shown in Table 3) and the rest of the coloring material layers was limited (the applied energy profile L shown in Table 3). In forming the images k to m, two of the coloring material layers I, II, and III are highlighted (the applied energy profile H shown in Table 3) and the remainder coloring material layer was limited (the applied energy profile L shown in Table 3).

TABLE 6

| Image | Coloring material | Corresponding coloring material | Printing E | | | | | P | | | | | | | | OD |
|---|---|---|---|---|---|---|---|---|---|---|---|---|---|---|---|---|
| No. | layer used | layer | I | II | III | C | L* | a* | b* | Lx | Ly | ax | ay | bx | by | (max) |
| g | D1-D2-D3 | I-II-III | N | N | N | 3.55 | equivalent to 38 | 3.42 | −0.94 | 42.85 | 33.66 | 2.86 | 3.93 | −1.17 | −0.73 | 2.28 |
| h | D1-D2-D3 | I-II-III | H | L | L | 0.44 | equivalent to 38 | 0.03 | 0.44 | 41.36 | 33.08 | −0.36 | 0.60 | 0.32 | 0.61 | 2.26 |
| i | D1-D2-D3 | I-II-III | L | H | L | 4.89 | equivalent to 38 | 1.38 | −4.69 | 39.06 | 30.55 | 1.25 | 2.29 | −4.70 | −4.59 | 2.22 |
| j | D1-D2-D3 | I-II-III | L | L | H | 7.62 | equivalent to 38 | 7.60 | 0.57 | 40.01 | 31.92 | 7.29 | 8.53 | 0.58 | 0.54 | 2.27 |
| k | D1-D2-D3 | I-II-III | H | H | L | 3.02 | equivalent to 38 | −0.10 | −3.02 | 39.00 | 29.41 | −0.21 | 0.83 | −3.05 | −2.72 | 2.28 |
| l | D1-D2-D3 | I-II-III | H | L | H | 5.50 | equivalent to 38 | 5.17 | −1.87 | 47.21 | 37.95 | 3.94 | 5.18 | −2.22 | −1.87 | 2.25 |
| m | D1-D2-D3 | I-II-III | L | H | H | 4.79 | equivalent to 38 | 4.66 | 1.12 | 40.31 | 30.77 | 4.35 | 5.61 | 1.01 | 1.45 | 2.27 |

Figure 3:
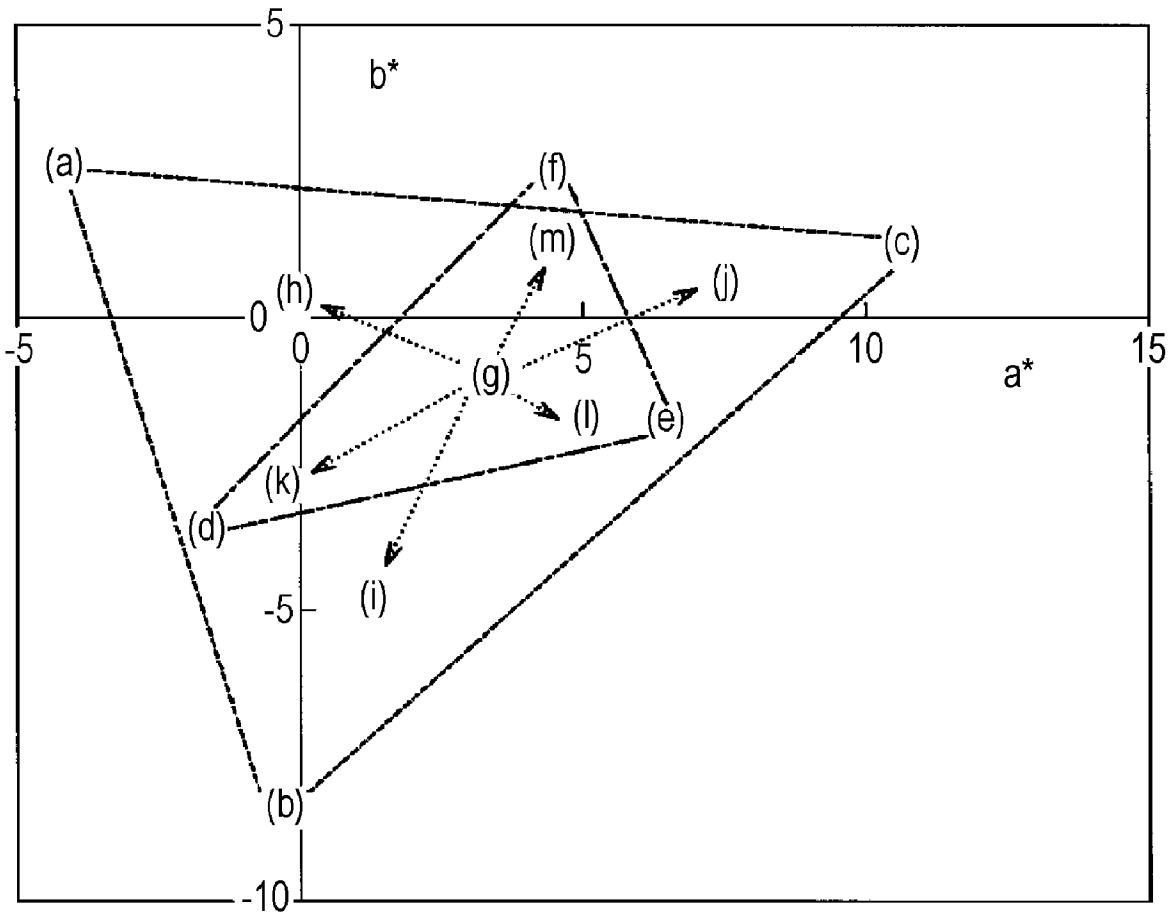
FIG. 3 is a L*a*b* chromaticity diagram of images formed by coloring material layers $D_1$, $D_2$, and $D_3$ (coloring material layers I, II, and III)

As shown in FIG. 3, gray tones with tint of colors can be created by using the coloring material layers I, II, and III.

Next, the case in which a thermal transfer sheet 1 having coloring material layers IV and V shown in Table 7 instead of the coloring material layers I, II, and III is used is described.

This thermal transfer sheet 1 was prepared by replacing the yellow and magenta color patches of a thermal transfer sheet of Print Pack (UPC-R154H produced by Sony Corporation) by the coloring material layers IV and V shown in Table 7 below. The coloring material layers IV and V were arranged in a plane sequential manner. The coloring material layers IV and V correspond to coloring material layers $D_1$ and $D_2$ and the cyan color patch is not used in thermal transfer in this example.

TABLE 7

(Unit: parts by weight)

| | Coloring material layers | |
|---|---|---|
| | IV | V |
| C.I. Disperse Orange 13 | 1.737 | 1.495 |
| C.I. Disperse Blue 148 | 1.737 | 1.794 |
| C.I. Disperse Violet 26 | 0.000 | 0.192 |
| C.I. Disperse Red 343 | 0.126 | 0.120 |
| Denka Butyral 6000AS (acetoacetal resin produced by Denki Kagaku Kogyo Kabushiki Kaisha) | 2.400 | 2.400 |

TABLE 7-continued (Unit: parts by weight)

| | Coloring material layers | |
|---|---|---|
| | IV | V |
| Methyl ethyl ketone | 47.000 | 47.000 |
| Toluene | 47.000 | 47.000 |
| Total | 100.000 | 100.000 |

As in the case of using the coloring material layers I, II, and III described above, a 16-step stairstep pattern was printed by applying energy to the coloring material layers IV and V of the thermal transfer sheet 1 according to an applied energy profile shown in Table 3. Then the chroma values C defined by mathematical formula 1 and the colorimetric values a*, b* defined by mathematical formulae 2 and 3 of images a to g equivalent to L*=38 were determined. The results of the images a and b independently printed using the coloring material layers IV and V are shown in Table 8. The results of the images c to g printed by using both the coloring material layers IV and V are shown in Table 9. The images a to g were plotted in the L*a*b* chromaticity diagram, as indicated by a to g in FIG. 4. In forming the images a to c, energy was evenly applied to the coloring material layers IV and V (the applied energy profile N shown in Table 3). In forming the images d and e, one of the coloring material layers IV and V was weakly highlighted (the applied energy profile HW shown in Table 3). In forming the images f and g, one of the coloring material layers IV and V was strongly highlighted (the applied energy profile HS shown in Table 3).

TABLE 8

| Image | Coloring material | Corresponding coloring material | Printing E | | | | | P | | | | | | | | OD |
|---|---|---|---|---|---|---|---|---|---|---|---|---|---|---|---|---|
| No. | layer used | layer | IV | V | — | C | L* | a* | b* | Lx | Ly | ax | ay | bx | by | (max) |
| a | D1 | IV | N | — | — | 1.21 | equivalent to 38 | −0.73 | −0.96 | 43.64 | 37.67 | −1.07 | −0.71 | −0.84 | −0.97 | 1.32 |
| b | D2 | V | — | N | — | 7.09 | equivalent to 38 | 1.34 | −6.97 | 38.08 | 32.53 | 1.33 | 1.97 | −6.96 | −7.47 | 1.34 |

TABLE 9

| | Coloring material | Corresponding coloring | Printing E | | | | | P | | | | | | | | |
|---|---|---|---|---|---|---|---|---|---|---|---|---|---|---|---|---|
| Image No. | layer used | material layer | IV | V | C | L* | a* | b* | Lx | Ly | ax | ay | bx | by | OD (max) |
| c | D1-D2 | IV-V | N | N | 4.06 | equivalent to 38 | 0.50 | −4.03 | 44.04 | 35.78 | 0.08 | 0.66 | −4.07 | −4.01 | 1.94 |
| d | D1-D2 | IV-V | HW | N | 2.82 | equivalent to 38 | 0.02 | −2.82 | 38.43 | 29.64 | −0.02 | 0.81 | −2.82 | −2.79 | 1.95 |
| e | D1-D2 | IV-V | N | HW | 5.47 | equivalent to 38 | 0.96 | −5.39 | 38.95 | 29.99 | 0.86 | 1.76 | −5.35 | −5.73 | 1.94 |
| f | D1-D2 | IV-V | HS | N | 3.26 | equivalent to 38 | 0.21 | −3.25 | 45.95 | 37.01 | −0.30 | 0.27 | −3.36 | −3.24 | 1.94 |
| g | D1-D2 | V-V | N | HS | 4.80 | equivalent to 38 | 0.74 | −4.74 | 46.46 | 37.43 | 0.15 | 0.78 | −4.59 | −4.75 | 1.95 |

Figure 4:
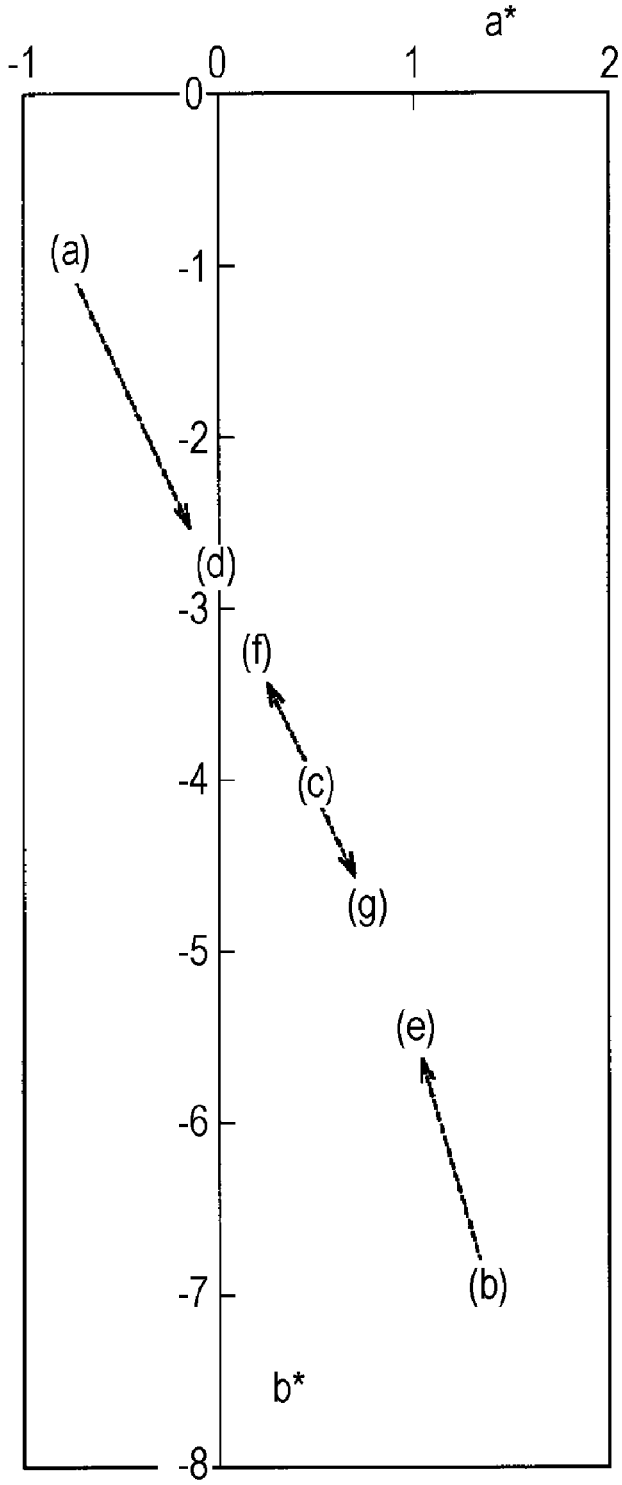
FIG. 4 is a L*a*b* chromaticity diagram of images formed by coloring material layers IV and V.

As shown in FIG. 4, gray tones with tint of colors can also be created by using the coloring material layers IV and V.

Next, the case in which a thermal transfer sheet 1 having coloring material layers VI, VII, and VIII shown in Table 10 instead of the coloring material layers I, II, and III is used is described.

The thermal transfer sheet 1 was prepared as with the thermal transfer sheet 1 having the coloring material layers I, II, and III described above except that the coloring material layers VI, VII, and VIII shown in Table 10 were formed instead of the coloring material layers I, II, and III.

TABLE 10

(Unit: parts by weight)

| | Coloring material layers | | |
|---|---|---|---|
| | VI | VII | VIII |
| C.I. Disperse Orange 13 | 1.607 | 1.505 | 1.463 |
| Dye represented by chemical formula 1 | 1.639 | 1.672 | 1.789 |
| Dye represented by chemical formula 2 | 0.525 | 0.589 | 0.520 |
| C.I. Disperse Violet 26 | 0.230 | 0.234 | 0.228 |
| Denka Butyral 6000AS (acetoacetal resin produced by Denki Kagaku Kogyo Kabushiki Kaisha) | 2.000 | 2.000 | 2.000 |
| Methyl ethyl ketone | 47.000 | 47.000 | 47.000 |
| Toluene | 47.000 | 47.000 | 47.000 |
| Total | 100.000 | 100.000 | 100.000 |

The dyes represented by chemical formulae 1 and 2 shown in Table 10 are as follows:

(Chem. formula 1)

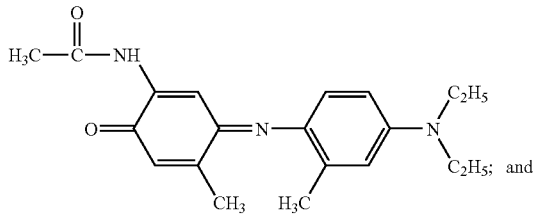

-continued (Chem. formula 2)

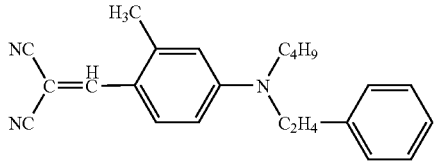

As in the case of using the thermal transfer sheet 1 having the coloring material layers I, II, and III described above, a 16-step stairstep pattern was printed by applying energy to the coloring material layers VI, VII, and VIII according to an applied energy profile shown in Table 3. Then the chroma values C defined by mathematical formula 1 and the colorimetric values a*, b* defined by mathematical formulae 2 and 3 of images a to m equivalent to L*=38 were determined. The results of the images a to c respectively printed using the coloring material layers VI, VII, and VIII are shown in Table 11. The results of the images d to f printed by using two of the coloring material layers VI, VII, and VIII are shown in Table 12. The results of the images g to m printed by using all of the coloring material layers VI, VII, and VIII are shown in Table 13. The images a to m were plotted in the L*a*b* chromaticity diagram, as indicated by a to m in FIG. 5. In forming the images a to g, energy was evenly applied to all of the coloring material layers VI, VII, and VIII (the applied energy profile N shown in Table 3). In forming the printed images h to j, one of the coloring material layers VI, VII, and VIII was highlighted (the applied energy profile H shown in Table 3) and the rest of the coloring material layers was limited (the applied energy profile L shown in Table 3). In forming the images k to m, two of the coloring material layers VI, VII, and VIII were highlighted (the applied energy profile H shown in Table 3) and the remainder coloring material layer was limited (the applied energy profile L shown in Table 3).

TABLE 11

| Image No. | Coloring material layer used | Corresponding coloring material layer | Printing E | | | C | L* | P | | Lx | Ly | ax | ay | bx | by | OD (max) |
|---|---|---|---|---|---|---|---|---|---|---|---|---|---|---|---|---|
| | | | VI | VII | VIII | | | a* | b* | | | | | | | |
| a | D1 | VI | N | — | — | 2.23 | equivalent to 38 | −0.02 | 2.23 | 38.98 | 33.56 | −0.11 | 0.39 | 2.16 | 2.52 | 1.36 |
| b | D2 | VII | — | N | — | 2.82 | equivalent to 38 | 2.28 | −1.67 | 42.63 | 36.78 | 2.03 | 2.34 | −1.89 | −1.61 | 1.41 |
| c | D3 | VIII | — | — | N | 2.93 | equivalent to 38 | −1.55 | −2.49 | 42.26 | 36.89 | −1.71 | −1.51 | −2.65 | −2.45 | 1.38 |

TABLE 12

| Image No. | Coloring material layer used | Corresponding coloring material layer | Printing E | | | C | L* | P | | Lx | Ly | ax | ay | bx | by | OD (max) |
|---|---|---|---|---|---|---|---|---|---|---|---|---|---|---|---|---|
| | | | VI | VII | VIII | | | a* | b* | | | | | | | |
| d | D1-D2 | VI-VII | N | N | — | 1.29 | equivalent to 38 | 0.99 | −0.82 | 44.53 | 36.42 | 0.95 | 1.00 | −1.40 | −0.68 | 2.09 |
| e | D2-D3 | VII-VIII | — | N | N | 2.03 | equivalent to 38 | −1.47 | −1.40 | 44.38 | 36.28 | −1.37 | −1.50 | −1.90 | −1.26 | 2.05 |
| f | D1-D3 | VI-VIII | N | — | N | 2.83 | equivalent to 38 | −0.37 | −2.80 | 42.03 | 34.31 | −0.38 | −0.36 | −3.07 | −2.56 | 2.11 |

TABLE 13

| Image No. | Coloring material layer used | Corresponding coloring material layer | Printing E VI | VII | VIII | C | L* | P a* | b* | Lx | Ly | ax | ay | bx | by | OD (max) |
|---|---|---|---|---|---|---|---|---|---|---|---|---|---|---|---|---|
| g | D1-D2-D3 | VI-VII-VIII | N | N | N | 2.50 | equivalent to 38 | −0.57 | −2.44 | 43.81 | 35.03 | −0.54 | −0.59 | −2.88 | −2.21 | 2.61 |
| h | D1-D2-D3 | VI-VII-VIII | H | L | L | 0.63 | equivalent to 38 | −0.23 | −0.59 | 43.16 | 34.35 | −0.19 | −0.25 | −0.92 | −0.36 | 2.52 |
| i | D1-D2-D3 | VI-VII-VIII | L | H | L | 2.50 | equivalent to 38 | 0.91 | −2.33 | 42.24 | 33.75 | 0.90 | 0.92 | −2.59 | −2.06 | 2.51 |
| j | D1-D2-D3 | VI-VII-VIII | L | L | H | 3.00 | equivalent to 38 | −1.20 | −2.75 | 42.13 | 33.82 | −1.19 | −1.22 | −2.93 | −2.56 | 2.51 |
| k | D1-D2-D3 | VI-VII-VIII | H | H | L | 1.70 | equivalent to 38 | 0.47 | −1.63 | 42.23 | 33.04 | 0.50 | 0.43 | −1.93 | −1.28 | 2.52 |
| l | D1-D2-D3 | VI-VII-VIII | H | L | H | 2.14 | equivalent to 38 | −1.00 | −1.89 | 42.11 | 32.42 | −0.95 | −1.07 | −2.15 | −1.54 | 2.53 |
| m | D1-D2-D3 | VI-VII-VIII | L | H | H | 2.98 | equivalent to 38 | −0.36 | −2.96 | 41.09 | 31.97 | −0.35 | −0.37 | −3.13 | −2.63 | 2.53 |

Figure 5:
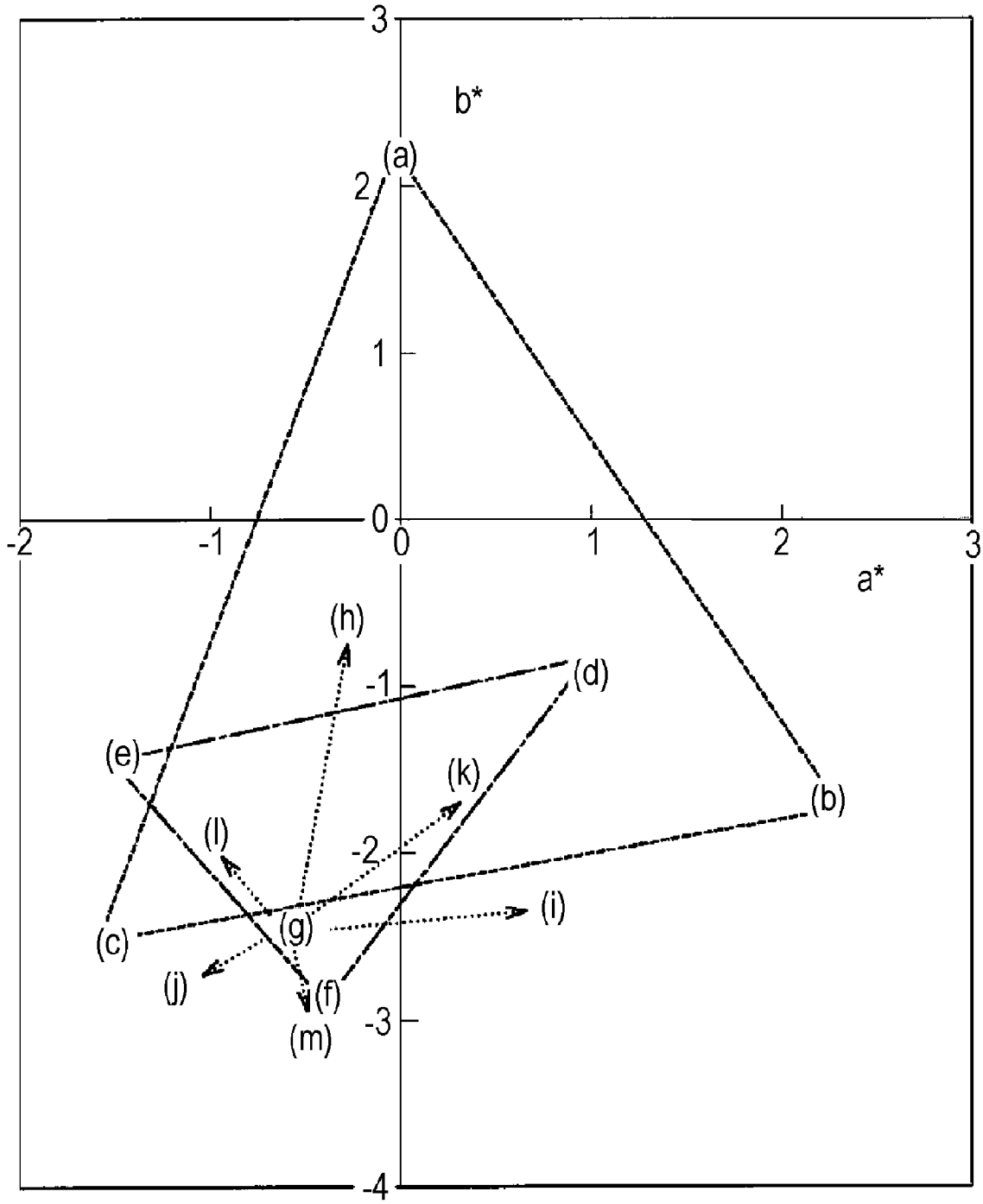
FIG. 5 is a L*a*b* chromaticity diagram of images formed by coloring material layers VI, VII, and VIII.

As shown in FIG. 5, gray tones with tint of colors can also be created by using the coloring material layers VI, VII, and VIII.

Next, the case in which a thermal transfer sheet 1 having coloring material layers IX and X shown in Table 14 instead of the coloring material layers IV and V is used is described.

The thermal transfer sheet 1 was prepared as with the thermal transfer sheet 1 having the coloring material layers IV and V described above except that the coloring material layers IX and X were formed instead of the coloring material layers IV and V. The dyes represented by chemical formulae 1 and 2 in Table 14 are the same as those used for the coloring material layers VI, VII, and VIII.

TABLE 14

(Unit: parts by weight)

| | Coloring material layers IX | X |
|---|---|---|
| C.I. Disperse Orange 13 | 1.607 | 1.484 |
| Dye represented by chemical formula 1 | 1.639 | 1.731 |
| Dye represented by chemical formula 2 | 0.525 | 0.554 |
| C.I. Disperse Violet 26 | 0.230 | 0.231 |
| Denka Butyral 6000AS (acetoacetal resin produced by Denki Kagaku Kogyo Kabushiki Kaisha) | 2.000 | 2.000 |

TABLE 14-continued (Unit: parts by weight)

| | Coloring material layers IX | X |
|---|---|---|
| Methyl ethyl ketone | 47.000 | 47.000 |
| Toluene | 47.000 | 47.000 |
| Total | 100.000 | 100.000 |

As in the case of using the thermal transfer sheet 1 having the coloring material layers IV and V described above, a 16-step stairstep pattern was printed by applying energy to the coloring material layers IX and X according to an applied energy profile shown in Table 3. Then the chroma values C defined by mathematical formula 1 and the colorimetric values a*, b* defined by mathematical formulae 2 and 3 of images a to g equivalent to L*=38 were determined. The results are shown in Tables 15 and 16. The images a to g were plotted in a L*a*b* chromaticity diagram, as indicated by a to g in FIG. 6. In forming the images a to c, energy was evenly applied to the coloring material layers IX and X (the applied energy profile N shown in Table 3). In forming the images d and e, one of the coloring material layers IX and X was weakly highlighted (the applied energy profile HW shown in Table 3). In forming the images f and g, one of the coloring material layers IX and X was strongly highlighted (the applied energy profile HS shown in Table 3).

TABLE 15

| Image No. | Coloring material layer used | Corresponding coloring material layer | Printing E IX | X | C | L* | P a* | b* | Lx | Ly | ax | ay | bx | by | OD (max) |
|---|---|---|---|---|---|---|---|---|---|---|---|---|---|---|---|
| a | D1 | IX | N | — | 2.57 | equivalent to 38 | 0.18 | 2.56 | 41.03 | 35.79 | −0.01 | 0.32 | 2.36 | 2.71 | 1.29 |
| b | D2 | X | — | N | 1.90 | equivalent to 38 | 0.68 | −1.78 | 39.00 | 34.64 | 0.51 | 1.24 | −1.79 | −1.73 | 1.19 |

TABLE 16

| Image No. | Coloring material layer used | Corresponding coloring material layer | Printing E IX | X | C | L* | P a* | b* | Lx | Ly | ax | ay | bx | by | OD (max) |
|---|---|---|---|---|---|---|---|---|---|---|---|---|---|---|---|
| c | D1-D2 | IX-X | N | N | 0.40 | equivalent to 38 | −0.19 | −0.35 | 38.16 | 30.37 | −0.19 | −0.16 | −0.36 | 0.13 | 1.92 |
| d | D1-D2 | IX-X | HW | N | 0.24 | equivalent to 38 | −0.15 | 0.19 | 40.61 | 31.92 | −0.15 | −0.16 | −0.01 | 0.66 | 1.91 |
| e | D1-D2 | IX-X | N | HW | 0.84 | equivalent to 38 | −0.07 | −0.84 | 40.39 | 32.06 | −0.09 | −0.03 | −0.98 | −0.48 | 1.89 |
| f | D1-D2 | IX-X | HS | N | 0.72 | equivalent to 38 | −0.08 | 0.72 | 43.22 | 34.14 | −0.09 | −0.07 | 0.35 | 0.99 | 1.98 |
| g | D1-D2 | IX-X | N | HS | 1.24 | equivalent to 38 | 0.01 | −0.24 | 43.17 | 33.72 | −0.04 | 0.06 | −1.54 | −1.00 | 1.88 |

Figure 6:
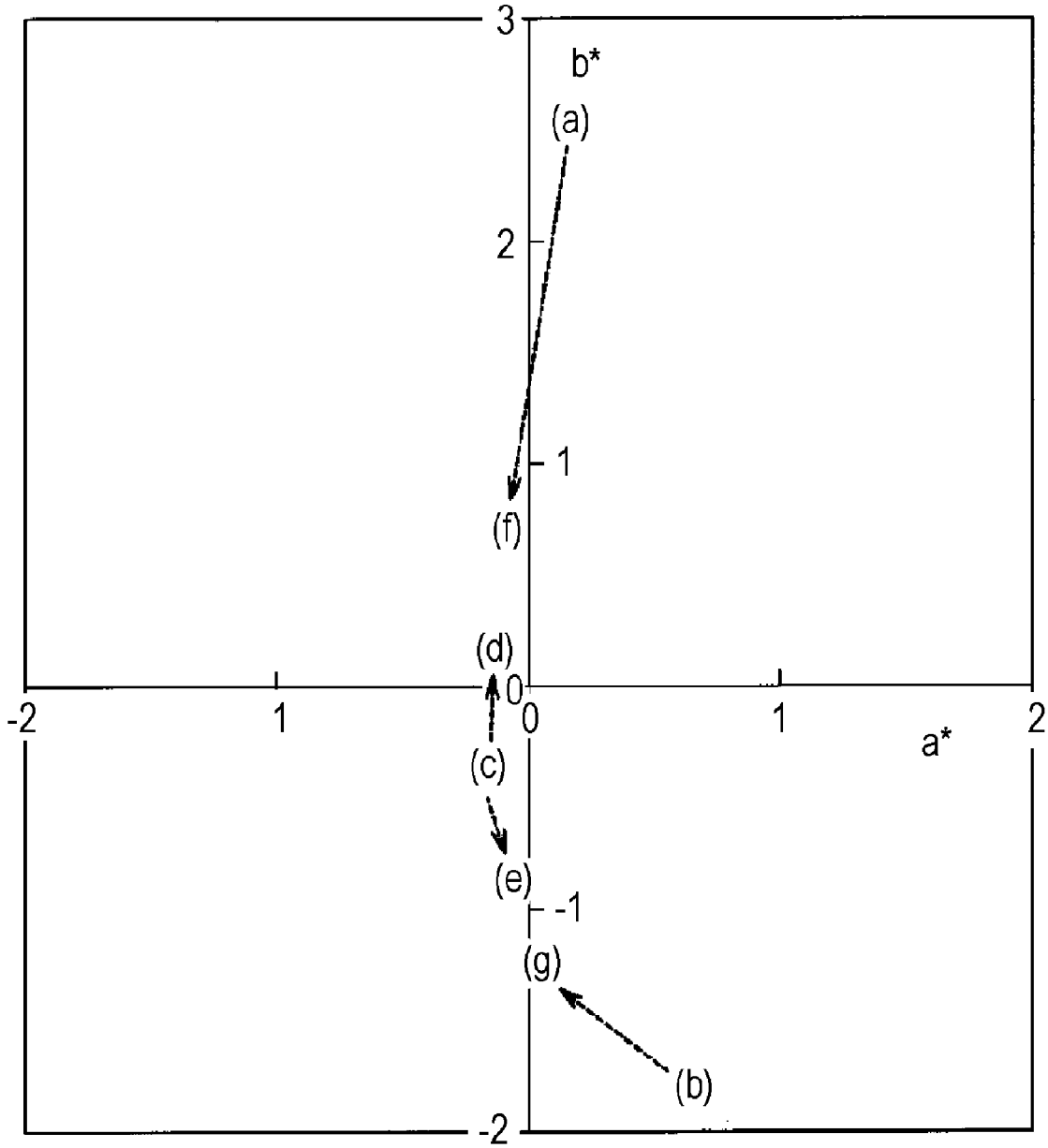
FIG. 6 is a L*a*b* chromaticity diagram of images formed by coloring material layers IX and X.

As shown in FIG. 6, gray tones with tint of colors can also be created by using the coloring material layers IX and X.

As a comparison to the thermal transfer sheet 1 having low-chroma coloring material layers (coloring material layers I, II, and III etc.) described above, a thermal transfer sheet of Print Pack UPC-R154H produced by Sony Corporation was used. This thermal transfer sheet and a thermal transfer-receiving sheet were used in combination in a color dye sublimation thermal transfer printing apparatus (DR150 produced by Sony Corporation) to produce black 16-step gradation images using yellow, magenta, and cyan coloring material layers by using the internal γ of the printing apparatus. Although 16-step gradation printing was conducted by using each of the yellow, magenta, and cyan coloring material layers alone, the gradation step exhibiting near L*=38 could not be obtained from single coloring material layer due to excessively high lightness.

The thermal transfer sheet 1 having the coloring material layers I, II, and III, the thermal transfer sheet 1 having the coloring material layers IV and V, the thermal transfer sheet 1 having the coloring material layers VI, VII, and VIII, the thermal transfer sheet 1 having the coloring material layers IX and X, and a thermal transfer sheet having yellow, magenta, and cyan coloring layers were used to form gray-tone 16-step gradation images, and the color tone of the images were observed with naked eye. The results are shown in Table 17. In Table 17, images exhibiting noticeable hue shift were rated "poor" and images exhibiting hue shift not so noticeable were rated "good".

| | Evaluation of hue shift |
|---|---|
| Coloring material layers I, II, and III | Good |
| Coloring material layers IV and V | Good |
| Coloring material layers VI, VII, and VIII | Good |
| Coloring material layers IX and X | Good |
| Yellow, magenta, and cyan | Poor |

The results in Table 17 show that the thermal transfer sheet having the yellow, magenta, and cyan coloring material layers exhibits noticeable hue shift between gradation steps.

In contrast, the images formed by using the thermal transfer sheets 1 having the coloring material layers I, II, and III, the coloring material layers IV and V, the coloring material layers VI, VII, and VIII, and the coloring material layers IX and X do not have noticeable hue shift. This is because the chroma value C defined by mathematical formula 1 is less than 12 and the colorimetric values a*, b* defined by mathematical formulae 2 and 3 equivalent to L*=38 are different from one another.

Although the coloring material layer unit D described above includes three types of coloring material layers, namely, the coloring material layers $D_1$, $D_2$, and $D_3$ (coloring material layers I, II, and III and the like), the coloring material layer unit D may include coloring material layers $D_4$, $D_5$, and the like having different chroma C and/or colorimetric value P (a*, b*). Two or more coloring material layer are formed sequentially on the surface.

The thermal transfer sheet 1 may also include a transferrable protective layer for protecting an image, in addition to the coloring material layer unit D, if required. The transferrable protective layer may be disposed between the coloring material layer units D and transferred onto a monochromic image formed by the coloring material layer unit D to provide protection.

According to the method for forming an image with the thermal transfer printing apparatus 10 and the thermal transfer sheet 1, the chroma values C of the images formed by the coloring material layers $D_1$, $D_2$, and $D_3$ defined by mathematical formula 1 are less than 12 and the colorimetric values P (a*, b*) of the images formed by the coloring material layers $D_1$, $D_2$, and $D_3$ defined by mathematical formulae 2 and 3 are different from one another. Thus, when the coloring material layers $D_1$, $D_2$, and $D_3$ are used, a print density of a practical level can be achieved, the hue shift in the low-density-regions can be made less noticeable, and a gray tone desired by a user, such as bluish or reddish gray tone, can be obtained. Thus, a low-chroma print that satisfies all of these features simultaneously can be formed.

Figure 7:
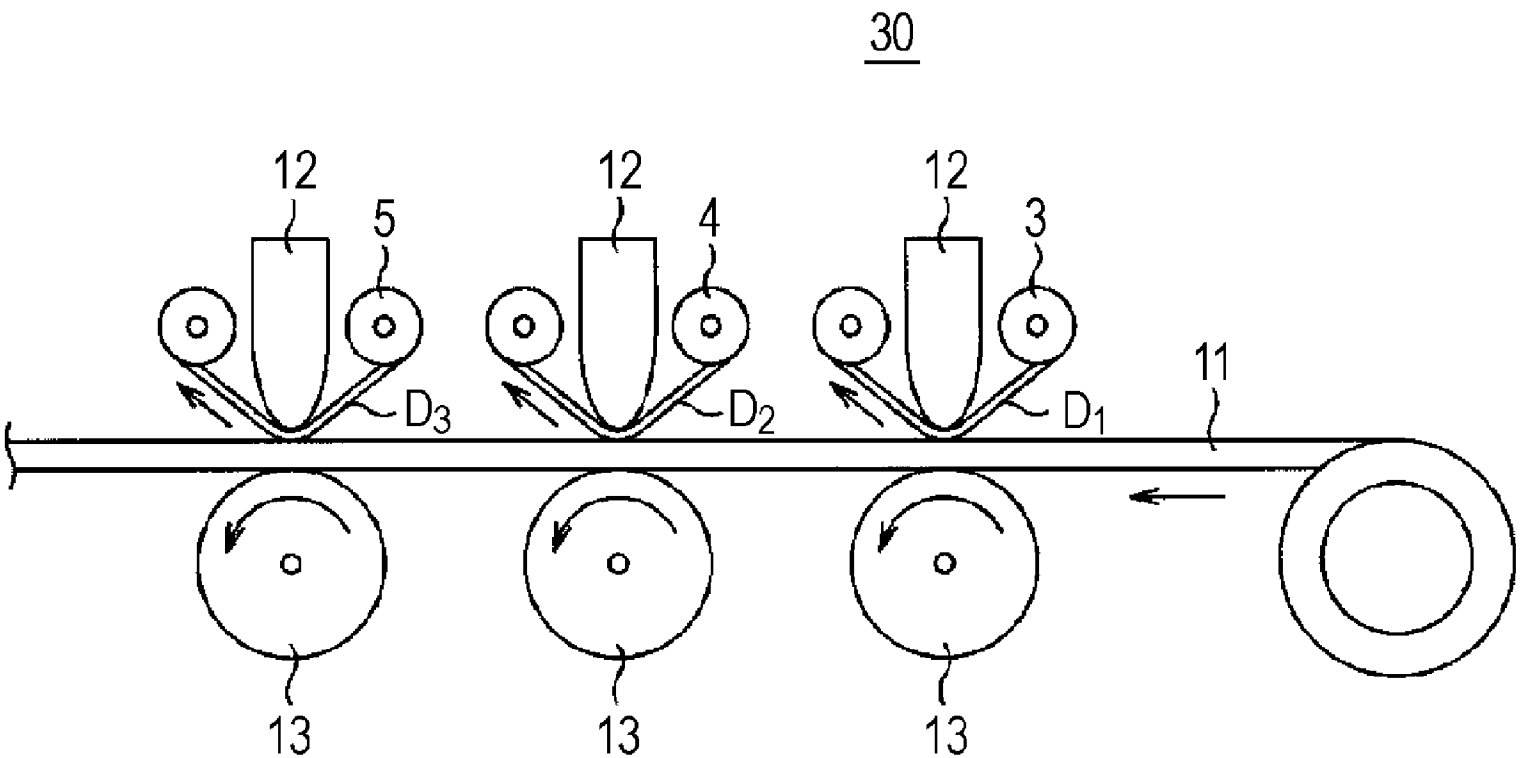
FIG. 7 is a schematic view of a tandem-type thermal transfer printing apparatus.

According to the image-forming method described above, the thermal transfer printing apparatus 10 having one thermal head serving as a heat-application unit for heating the thermal transfer sheet 1 is used. Alternatively, a thermal transfer printing apparatus 30 of a tandem type shown in FIG. 7 having a plurality of heat-application units, i.e., thermal heads, may be used.

The tandem-type thermal transfer printing apparatus 30 uses a thermal transfer sheet 3 provided with the coloring material layer $D_1$, a thermal transfer sheet 4 provided with the coloring material layer $D_2$, and a thermal transfer sheet 5 provided with the coloring material layer $D_3$. In other words, the coloring material layers $D_1$, $D_2$, and $D_3$ provided in the thermal transfer sheet 1 are independently provided on separate thermal transfer sheets. The thermal transfer printing apparatus 30 uses a thermal transfer sheet set 6 that includes the thermal transfer sheets 3, 4, and 5.

The tandem-type thermal transfer printing apparatus 30 has a thermal head 12 and a platen 13 for each of the thermal transfer sheets 3, 4, and 5. As in the thermal transfer printing apparatus 10 described above, the thermal heads 12 for the thermal transfer sheets 3, 4, and 5 are independently driven according to recording signals, and the dyes in the coloring material layers $D_1$, $D_2$, and $D_3$ are selectively heated to transfer the dyes onto the thermal transfer-receiving sheet 11 fed into the apparatus to thereby form monochromic images. Note that components of the thermal transfer printing apparatus 30 similar to those of the thermal transfer printing apparatus 10 are represented by the same reference numerals and detailed descriptions therefor are omitted.

Figure 8:
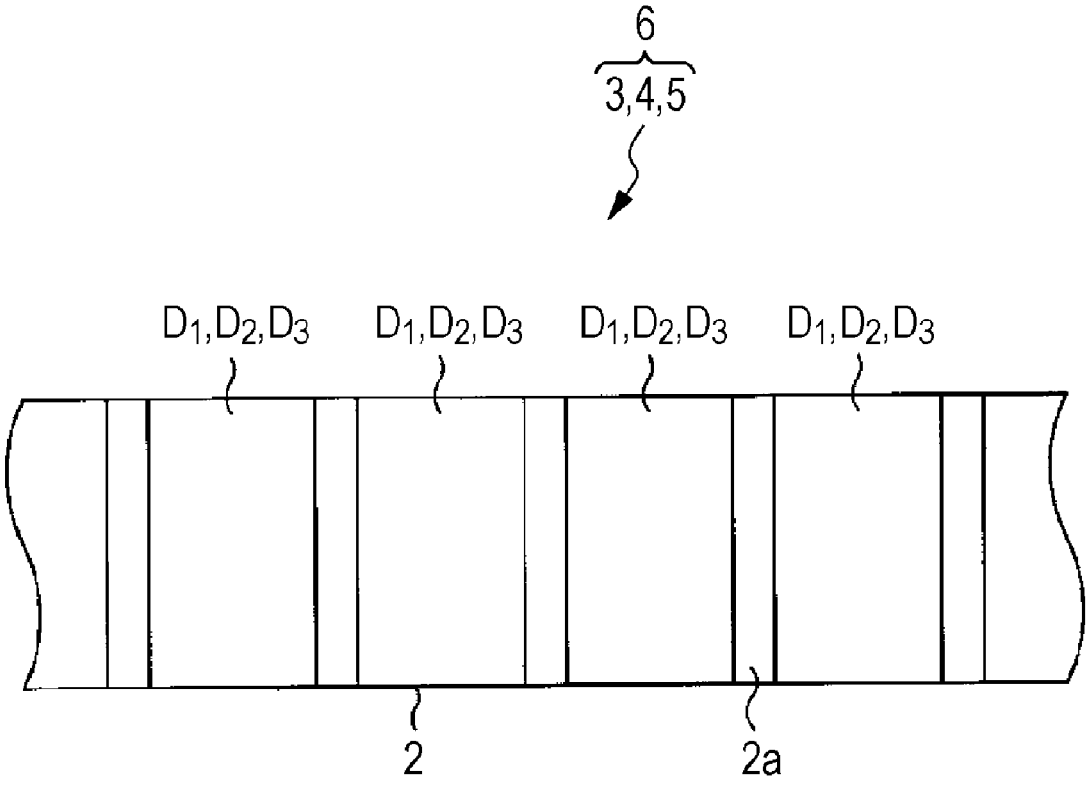
FIG. 8 is a plan view of a thermal transfer sheet of another embodiment.

As shown in FIG. 8, the thermal transfer sheet 3 included in the thermal transfer sheet set 6 used in the tandem-type thermal transfer printing apparatus 30 has the same coloring material layers $D_1$ as the thermal transfer sheet 1 described above. The coloring material layers $D_1$ are formed on a surface 2*a* of a substrate 2 in a plane sequential manner. Similarly, the same coloring material layers $D_2$ as the thermal transfer sheet 1 are formed on the thermal transfer sheet 4 in a plane sequential manner, and the same coloring material layers $D_3$ as the thermal transfer sheet 1 are formed on the thermal transfer sheet 5 in a plane sequential manner. In other words, the thermal transfer sheet set 6 may have the coloring material layers I, II, and III, the coloring material layers IV and V, the coloring material layers VI, VII, and VIII, or the coloring material layers IX and X described above. Thus, as in the thermal transfer sheet 1 described above and shown by tables 4 to 6, 8, 9, 11 to 13, 15, and 16, the images respectively formed by the coloring material layers $D_1$, $D_2$, and $D_3$ of the thermal transfer sheets 3, 4, and 5 have chroma values C defined by mathematical formula 1 of less than 12, and colorimetric values P (a*, b*), defined by mathematical formulae 2 and 3, different from one another.

According to the method for forming an image with the thermal transfer printing apparatus 30 and the thermal transfer sheet set 6, the chroma values C of the images formed by the coloring material layers $D_1$, $D_2$, and $D_3$ of the thermal transfer sheets 3, 4, and 5 of the thermal transfer sheet set 6, defined by mathematical formula 1 are less than 12 and the colorimetric values P (a*, b*) of these images defined by mathematical formulae 2 and 3 are different from one another. Thus, when the thermal transfer sheets 3, 4, 5 respectively having the coloring material layers $D_1$, $D_2$, and $D_3$ are used, a print density of a practical level can be achieved, the hue shift in the low-density-regions can be made less noticeable, and a gray tone desired by a user, such as bluish or reddish gray tone, can be obtained. Thus, a low-chroma print that satisfies all of these features simultaneously can be formed.

Each of the thermal transfer sheets 3, 4, and 5 may include a transferrable protective layer for protecting an image in addition to the coloring material layers $D_1$, $D_2$, or $D_3$, if necessary. The transferrable protective layers may be disposed between the coloring material layers $D_1$, $D_2$, and $D_3$ and transferred onto monochromic images formed by the coloring material layers $D_1$, $D_2$, and $D_3$ to provide protection.

The thermal transfer sheet set 6 may further include another thermal transfer sheet having a coloring material layer with different chroma C and colorimetric value P (a*, b*) in addition to the thermal transfer sheets 3, 4, and 5 described above depending on the color tone of the images to be printed, for example. The thermal transfer sheet set 6 may include two or more thermal transfer sheets.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal transfer sheet comprising:

a substrate, and a plurality of coloring material layer units disposed on one surface of the substrate in a plane sequential manner, each of the coloring material layer units including at least two types of coloring material layers arranged parallel to each other, the coloring material layers containing coloring materials, wherein the coloring materials are thermally transferred onto an image-receiving layer of a thermal transfer-receiving sheet superimposed with the thermal transfer sheet to form transferred images, the transferred images formed by the coloring material layers in each coloring material unit have a value C defined by mathematical formula 1 below of less than 12, and colorimetric values P (a*, b*) of the transferred images defined by mathematical formulae 2 and 3 below are different from one another within each coloring material unit:

$$C=([a^*]^2+[b^*]^2)^{0.5} \quad \text{(mathematical formula 1)}$$

where C represents chroma and a* and b* each represent a colorimetric value (CIE 1976 L*a*b* color space with D65 illuminant, 2° field of view) equivalent to L*=38;

$$[a^*]=(ay-ax)/(Ly-Lx)*(38-Lx)+ax \quad \text{(mathematical formula 2)}$$

$$[b^*]=(by-bx)/(Ly-Lx)*(38-Lx)+bx \quad \text{(mathematical formula 3)}$$

where Lx, ax, bx, Ly, ay, and by represent colorimetric values at adjacent step Sx and step Sy near L*=38 when stairstep images are formed by transfer on the image-receiving layer of the thermal transfer-receiving sheet by using the coloring material layers; and Colorimetric values (L*, a*, b*) at step Sx=(Lx, ax, bx)

Colorimetric values (L*, a*, b*) at step Sy=(Ly, ay, by)

where Lx<38<Ly or Lx>38>Ly.

2. A thermal transfer sheet set comprising:

a plurality of thermal transfer sheets each including a substrate and a different type of coloring material layers formed on one surface of the substrate, the coloring material layers including coloring materials, wherein the coloring materials are thermally transferred onto an image-receiving layer of a thermal transfer-receiving sheet superimposed with the thermal transfer sheets to form transferred images, the transferred images formed by the coloring material layers of the thermal transfer sheets have a value C defined by mathematical formula 1 below of less than 12, and colorimetric values P (a*, b*) of the transferred images defined by mathematical formulae 2 and 3 below are different from each other between the thermal transfer sheets within the thermal transfer sheet set:

$$C=([a^*]^2+[b^*]^2)^{0.5} \quad \text{(mathematical formula 1)}$$

where C represents chroma and a* and b* each represent a colorimetric value (CIE 1976 L*a*b* color space with D65 illuminant, 2° field of view) equivalent to L*=38;

$$[a^*]=(ay-ax)/(Ly-Lx)*(38-Lx)+ax \quad \text{(mathematical formula 2)}$$

$$[b^*]=(by-bx)/(Ly-Lx)*(38-Lx)+bx \quad \text{(mathematical formula 3)}$$

where Lx, ax, bx, Ly, ay, and by represent colorimetric values at adjacent step Sx and step Sy near L*=38 when stairstep images are formed by transfer on the image-receiving layer of the thermal transfer-receiving sheet by using the coloring material layers; and Colorimetric values (L*, a*, b*) at step Sx=(Lx, ax, bx)

Colorimetric values (L*, a*, b*) at step Sy=(Ly, ay, by)

where Lx<38<Ly or Lx>38>Ly.

3. A method for forming an image, comprising:

superimposing a thermal transfer sheet on a thermal transfer-receiving sheet; and thermally transferring a coloring material contained in a coloring material layer of the thermal transfer sheet onto an image-receiving layer of the thermal transfer-receiving sheet so as to form a transferred image, wherein at least two types of coloring material layers are used and thermal transfer of the coloring material from the coloring material layer onto the thermal transfer-receiving sheet is sequentially conducted to form transferred images, the transferred images formed by the coloring material layers have a value C defined by mathematical formula 1 below of less than 12, and colorimetric values P (a*, b*) of the transferred images defined by mathematical formulae 2 and 3 below are different from one another between the coloring material layers of the thermal transfer sheet:

$$C=([a^*]^2+[b^*]^2)^{0.5} \quad \text{(mathematical formula 1)}$$

where C represents chroma and a* and b* each represent a colorimetric value (CIE 1976 L*a*b* color space with D65 illuminant, 2° field of view) equivalent to L*=38 of the transferred images;

$$[a^*]=(ay-ax)/(Ly-Lx)*(38-Lx)+ax \quad \text{(mathematical formula 2)}$$

$$[b^*]=(by-bx)/(Ly-Lx)*(38-Lx)+bx \quad \text{(mathematical formula 3)}$$

where Lx, ax, bx, Ly, ay, and by represent colorimetric values at adjacent step Sx and step Sy near L*=38 when stairstep images are formed by transfer on the image-receiving layer of the thermal transfer-receiving sheet by using the coloring material layers; and Colorimetric values (L*, a*, b*) at step Sx=(Lx, ax, bx)

Colorimetric values (L*, a*, b*) at step Sy=(Ly, ay, by)

where Lx<38<Ly or Lx>38>Ly.

* * * * *